US006053341A

United States Patent [19]

Forsberg

[11] Patent Number: 6,053,341

[45] Date of Patent: Apr. 25, 2000

[54] DEVICE IN EXTENDIBLE CRANE BOOMS

[75] Inventor: Lars Forsberg, Harmånger, Sweden

[73] Assignee: Hiab AB, Hudiksvall, Sweden

[21] Appl. No.: 08/537,673

[22] PCT Filed: Apr. 15, 1994

[86] PCT No.: PCT/SE94/00333

§ 371 Date: Jan. 11, 1996

§ 102(e) Date: Jan. 11, 1996

[87] PCT Pub. No.: WO94/24035

PCT Pub. Date: Oct. 27, 1994

[30] Foreign Application Priority Data

Apr. 22, 1993 [SE] Sweden ..... 9301338

[51] Int. Cl.[7] ..... B66C 23/04

[52] U.S. Cl. ..... 212/349; 92/140

[58] Field of Search ..... 712/349; 92/140; 212/230, 231; 52/118; 403/13, 14

[56] References Cited

U.S. PATENT DOCUMENTS

| | | | |
|---|---|---|---|
| 2,666,417 | 1/1954 | Harsch | 52/118 |
| 3,700,126 | 10/1972 | Beaton | 212/231 |

FOREIGN PATENT DOCUMENTS

| | | | |
|---|---|---|---|
| 1556601 | 3/1970 | Germany | 212/349 |
| 1943314 | 4/1971 | Germany . | |
| 2448169 | 10/1975 | Germany . | |
| 284264 | 10/1970 | U.S.S.R. | 212/349 |

*Primary Examiner*—Thomas J. Brahan
*Attorney, Agent, or Firm*—Young & Thompson

[57] ABSTRACT

An extendible crane boom comprises a number of telescopic boom sections, which are each composed of a tube and a holder mounted at an outer end of the tube and serving as an attachment for a double-acting hydraulic cylinder which serves to displace the individual telescopic boom section out of or into an immediately preceding boom section so as to extend and shorten, respectively, the crane boom in its entirety. The cylinder part (7) of each hydraulic cylinder is connected to the holder via a coupling comprising a screw joint having several screws, and a pair of cooperating male and female members (11, 9), one of which has a part-spherical surface (18) which faces the other and which, when the screw joint is but loosely tightened, allows adjusting the cylinder part into a desired, correct working position in relation to the holder, in which position the screw joint (13) is finally tightened.

20 Claims, 1 Drawing Sheet

DEVICE IN EXTENDIBLE CRANE BOOMS

TECHNICAL FIELD OF THE INVENTION

This invention relates to a device in extendible crane booms of the type which, in addition to a tubular base boom section, comprises one or more boom sections arranged telescopically within the base boom section and each composed of a tube and a holder mounted at an outer end of the tube and serving as an attachment for a double-acting hydraulic cylinder which serves to displace an individual boom section out of or into an immediately preceding boom section so as to lengthen and shorten, respectively, the crane boom in its entirety.

BACKGROUND ART

Telescopic, extendible crane booms of the general type described above are often used as outer booms in knuckle-boom cranes. In addition to the base boom section articulated to the first boom section of the crane, they often include more than one telescopic boom section. Thus, a common crane type comprises, in addition to the base boom section, three telescopic boom sections (conventionally termed "extensions"), each of which is operated by means of an associated hydraulic cylinder whose cylinder part is fixed in the above-mentioned holder and extends in cantilevered fashion inwards from the holder while the piston rod can be extended outwards from the holder, thus entraining the telescopic boom section located immediately outside. When all the telescopic boom sections are retracted in the base boom section and the crane boom has minimum length, all these hydraulic cylinders will be located close to each other adjacent the outer side of the base boom section. Then, if the cylinder parts of the hydraulic cylinders are not in accurate parallel alignment with each other, they may risk to come into contact with each other or with other components of the crane boom construction, thus giving rise to abrasion and wear, and sometimes even collision phenomena. It therefore is extremely vital that the cylinder part of each hydraulic cylinder be mounted in an accurately defined, predetermined position with respect to the holder.

In prior-art cranes, two alternatives to solve the above problem have been used. In one alternative, the outer side of the cylinder part has fixedly mounted thereon two diametrically opposed pins which engage in corresponding holes in side members of the holder while a bracket-like member projects from the holder a slight distance towards the free end of the cylinder part and is fixed thereto spaced from said pins, which retain the cylinder part against lateral movements while the bracket-like member retains it against movements in the vertical direction. A serious drawback of this alternative is that the pins on the cylinder part as well as the holes in the holder require extremely meticulous and, hence, costly preparations to ensure that the cylinder part be located in the desired position parallel to the main axis of the crane boom. Also the bracket member increases the overall construction costs. Moreover, every subsequent adjustment of the position of the cylinder part is impossible. If, therefore, any cylinder part, after the crane has been used for some time, is moved out of its parallel position with respect to the crane axis, the crane boom must be dismounted and the faulty components exchanged. Not only is this a costly operation but it also involves considerable downtimes, during which the crane cannot be used. According to the other alternative, the cylinder part is connected to the holder via a flanged joint comprising a flange which is mounted on the cylinder part, engages with a flat surface a corresponding flat surface on the holder and is connected thereto via a suitable number of screws. In this case too, extremely meticulous preparations are required for the flange as well as the holder, especially in conjunction with the welding of the components included in the holder. Moreover, any subsequent adjustment of the position of the cylinder part is made with the aid of washers. This is a troublesome and time-consuming work.

OBJECTS AND FEATURES OF THE INVENTION

The present invention aims to overcome the above-mentioned drawbacks inherent in prior-art cranes and provide a device by means of which the parallelism between the individual hydraulic cylinder and the associated crane boom section can be ensured in a simple, efficient and cost-saving way. A basic object of the invention therefore is to provide a device which enables mounting the hydraulic cylinder on the associated holder without the need of any time-consuming and costly preparations in respect of the holder and the connection components on the cylinder part. Another object is to provide a device enabling subsequent adjustment of the position of the hydraulic cylinder relative to the holder in a simple manner.

According to the invention, the above-mentioned objects are achieved by means of the features recited in the characterising clause of appended claim 1. Other features of an especially preferred embodiment of the invention will appear from the dependent claims.

BRIEF DESCRIPTION OF THE ACCOMPANYING DRAWING

In the drawing,

FIG. 1 is a schematic, perspective exploded view illustrating the inventive coupling device between a cylinder part and a holder, and FIG. 2 is a simplified perspective view of an individual boom section included in a crane boom and having a holder, to which a hydraulic cylinder is connected via a coupling device according to claim 1.

DETAILED DESCRIPTION OF A PREFERRED EMBODIMENT OF THE INVENTION

Figure 2:
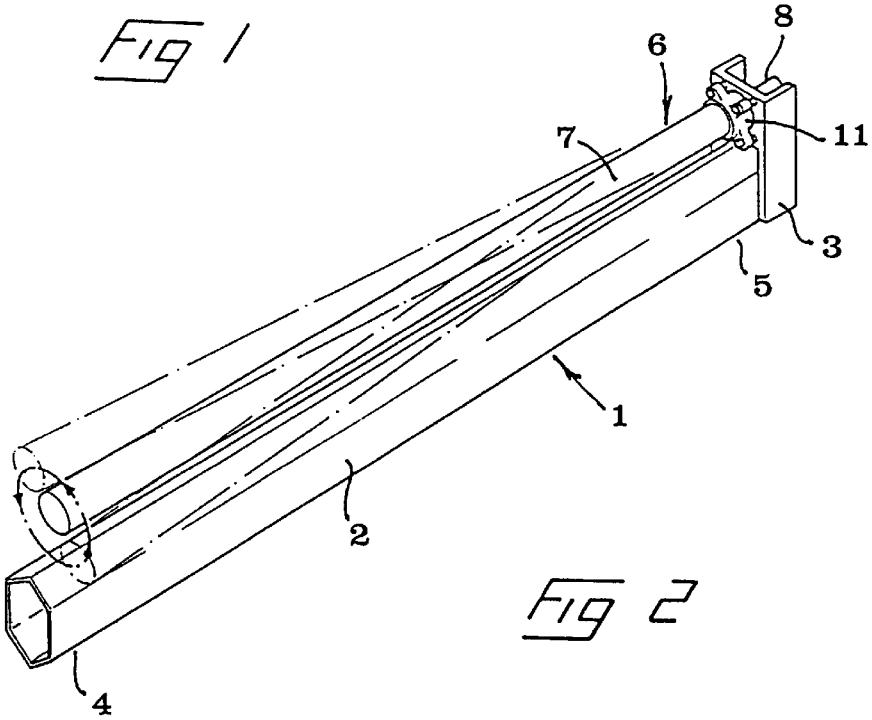

In the drawing, reference numeral 1 generally designates a crane boom section which is composed of a tube 2 and a holder 3, schematically illustrated. The tube 2, which in this example has a hexagonal cross-sectional shape, is open at both ends in the case when the boom section is telescopic and insertable in a base boom section (not shown) of e.g. an outer boom. An inner end of the tube or the boom section is designated 4 while an outer end thereof is designated 5. The holder 3 carries a hydraulic cylinder, generally designated 6, which in conventional manner includes a cylinder part 7 and a piston rod 8. Assuming that the boom section shown in FIG. 2 is one out of several telescopic boom sections, the inner end 4 is inserted in a base boom section or a telescopic boom section located inwardly thereof, while an outer boom section of smaller dimensions can be inserted in the outer end 5 of the tube 2. This outer telescopic boom section (not shown) then is movable back and forth relative to the tube 2 by means of the piston rod 8 of the hydraulic cylinder 6, the piston rod 8 being movable out of and into the cylinder part 7. To this end, the hydraulic cylinder 6 is double-acting.

Figure 1:
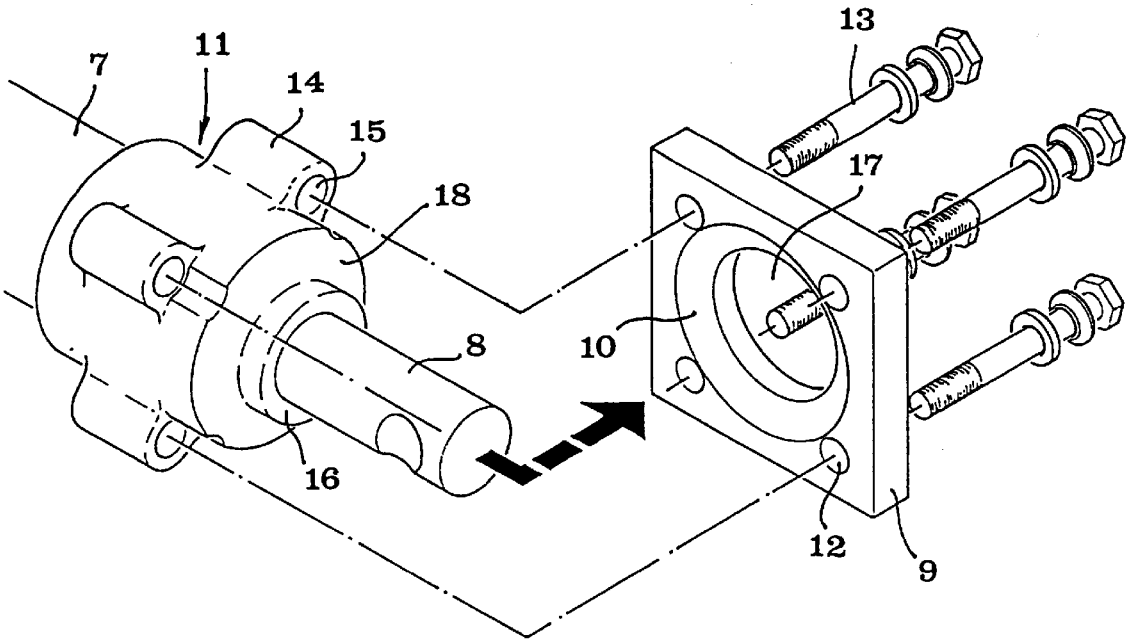

In FIG. 1, reference numeral 9 designates a female member having a seat or a seat surface 10, while 11 designates a male member. In FIG. 1, the female member 9 is schematically illustrated as a plate which in one way or another is included in the holder 3 and is a fixed part thereof. For example, the plate 9 may form part of a vertical, transverse flange included in the holder 3. The plate 9 has a plurality of holes 12 for receiving a corresponding number of screws 13. In the illustrated, preferred embodiment, the number of holes and screws is four.

The male member 11 consists of a ring or a substantially annular body which encloses the outer end of the cylinder part 9 and is fixedly connected to it, e.g. via a threaded joint, optionally a thermally-glued joint or, alternatively, a welded joint. On its circumferential surface, the ring 11 has a number of projections 14 corresponding to the number of screws and formed with internally threaded holes 15 for the screws. The outer end of the ring 11 terminates in a sleeve-like portion 16, through which the piston rod 8 is passed and which is insertable in a central hole 17 in the female plate 9.

According to the inventive principle of the invention, the illustrated coupling device includes between the cylinder part 7 and the holder 3 a part-spherical surface 18 which in this case is formed on the male member or ring 11. More specifically, the part-spherical surface 18 extends from the annular sleeve portion 16 out to the circumferential surface of the annular body 11. In the mounted state of the coupling, the part-spherical surface 18 is adapted to engage the above-mentioned seat surface 10 which in this example is assumed to have a conical or truncated shape. As a result, a line contact will exist between the male surface 18 and the female surface 10, more specifically in the form of an annular or circular contact line whose radial location along the female or seat surface 10 is determined by the relationship between the cone angle of the seat surface and the radius of the spherical surface 18. In the case of a small radius of the spherical surface, the contact line is located close to the hole 17 whereas in the case of a relatively large spherical radius, the contact line will be located further away from the hole 17, although still in contact with the female surface 10.

When the cylinder part 7 is to be mounted on the holder 3, the annular body 11 is brought into contact with the holder or the female plate 9, so that the convex part-spherical surface 18 comes into contact with the seat surface 10, and the screws 13 are initially tightened comparatively loosely in the associated threaded holes 15. In the next step, the cylinder part is aligned in a suitable manner to a position in which it is substantially exactly parallel to the longitudinal axis of the crane boom, i.e. the centre axis of the tube 2, whereupon the screws 13 are finally tightened so as to firmly hold the cylinder part in the given position parallel to said longitudinal axis. Thanks to the part-spherical shape of the engagement surface 18, the circular contact line between the surfaces 18 and 10 can be positioned in varying ways along the seat surface 10. This in turn means that the cylinder part 7 can be positioned in the desired axis-parallel position even if the component 9 forming part of the holder 11 is not in exact perpendicular alignment with the longitudinal axis or if the annular body 11 does not extend exactly coaxially with the cylinder part. In other words, the holder 3 and the coupling ring 11 can be manufactured and mounted without high tolerance requirements, whereby the overall cost of the crane boom can be reduced. Another advantage of the inventive coupling device is that, when required, it allows quick and easy subsequent adjustment of the position of the hydraulic cylinder relative to the associated boom section.

CONCEIVABLE MODIFICATIONS OF THE INVENTION

It is understood that the invention is not restricted only to the embodiment described above and illustrated in the drawing. Thus, the part-spherical surface need not necessarily be formed on a ring or coupling component associated precisely with the hydraulic cylinder, but may instead be formed on the holder or any other part connected thereto. Nor does the part-spherical surface necessarily be convex. Thus, it may instead be concave and cooperate with a suitable countersurface or counterpiece. Moreover, the seat surface receiving the male member may have a shape other than conical, e.g. be part-spherical having another radius than a part-spherical and convex engagement surface on the male member. Similarly, it should be pointed out that nor the illustrated part-spherical surface on the male member or the seat surface in the female member need necessarily be coherent and annular. Thus, these surfaces may have recesses or interruptions between individual partial surfaces which together form a part-spherical or conical configuration. For reasons of manufacture, it is however preferred in practice to have continuous, annular surfaces. Also, it is conceivable to form, for example, the seat in the female member from a number of spaced-apart, suitably shaped projections, against which a part-spherical surface can be engaged to permit pivoting the hydraulic cylinder in conjunction with mounting or subsequent adjustment. According to the invention, the essential thing thus is that either of two elements of male and female design included in the coupling device has a convex or, alternatively, a concave part-spherical surface or configuration that permits pivoting the hydraulic cylinder relative to a point of articulation located substantially coaxial with the longitudinal centre axis of the cylinder.

What is claimed is:

1. A coupling, for use with a tubular boom section of an extendible crane boom, said tubular boom section comprising a tube having an inner end and an outer end and a holder mounted to said tube at said outer end, a double-acting hydraulic cylinder being attachable to said holder by said coupling, said coupling comprising:

a male member and a female member, one of said male member and said female member being attachable to an outer end of said double-acting hydraulic cylinder and the other of said male member and said female member being attachable to said holder, and one of said male member and said female member comprising a substantially part-spherical surface and the other of said male member and said female member comprising an opposite surface in contact with said substantially part-spherical surface, and means comprising a plurality of screws coupling together said substantially part-spherical surface and said opposite surface for preventing pivotal movement of said double-acting hydraulic cylinder relative to said holder when said plurality of screws are tightened, and for permitting pivotal movement of said double-acting hydraulic cylinder relative to said holder when said plurality of screws are loosened.

2. A coupling as claimed in claim 1, wherein the substantially part-spherical surface is convex and formed on the male member.

3. A coupling as claimed in claim 2, wherein the male member comprises a ring configured to enclose a cylinder part of said double-acting hydraulic cylinder and being fixedly connectable thereto by a threaded or welded joint.

4. A coupling as claimed in claim 3, wherein the female member comprises a seat which is delimited by a concave surface of substantially conical shape which mates with the substantially part-spherical surface.

5. A coupling as claimed in claim 4, wherein the substantially part-spherical surface is annular and continuous.

6. A coupling as claimed in claim 4, wherein the concave surface is annular and continuous.

7. A coupling as claimed in claim 3, wherein the substantially part-spherical surface is annular and continuous.

8. A coupling as claimed in claim 2, wherein the female member comprises a seat which is delimited by a concave surface of substantially conical shape which mates with the substantially part-spherical surface.

9. A coupling as claimed in claim 8, wherein the substantially part-spherical surface is annular and continuous.

10. A coupling as claimed in claim 9, wherein the concave surface is annular and continuous.

11. A coupling as claimed in claim 8, wherein the concave surface is annular and continuous.

12. A coupling as claimed in claim 2, wherein the substantially part-spherical surface is annular and continuous.

13. A coupling as claimed in claim 12, wherein the concave surface is annular and continuous.

14. A coupling as claimed in claim 1, wherein the female member comprises a seat which is delimited by a concave surface of substantially conical shape which mates with the substantially part-spherical surface.

15. A coupling as claimed in claim 14, wherein the substantially part-spherical surface is annular and continuous.

16. A coupling as claimed in claim 14, wherein the concave surface is annular and continuous.

17. A coupling as claimed in claim 1, wherein the substantially part-spherical surface is annular and continuous.

18. A coupling as claimed in claim 17, wherein the concave surface is annular and continuous.

19. A coupling, for use with a tubular boom section of an extendible boom, said tubular boom section comprising a tube having a tube longitudinal axis and having an inner end and an outer end and a holder mounted to said tube at said outer end, a double-acting hydraulic cylinder having a cylinder longitudinal axis and being attachable to said holder by said coupling such that said tube longitudinal axis is substantially parallel to said cylinder longitudinal axis, said coupling comprising:

a male member and a female member, one of said male member and said female member being attachable to an outer end of said double-acting hydraulic cylinder and the other of said male member and said female member being attachable to said holder, and one of said male member and said female member comprising a substantially part-spherical surface configuration and the other of said male member and said female member comprising an opposite surface in contact with said substantially part-spherical surface, and means comprising a plurality of screws coupling together said substantially part-spherical surface and said opposite surface for preventing pivotal movement of said double-acting hydraulic cylinder relative to said holder, when said tube longitudinal axis is substantially parallel to said cylinder longitudinal axis and said plurality of screws are tightened, and for permitting pivotal movement of said double-acting hydraulic cylinder relative to said holder, to adjust any angular deviation from parallelism of said tube longitudinal axis relative to said cylinder longitudinal axis, when said plurality of screws are loosened.

20. A coupling, for use with a tubular boom section of an extendible crane boom, said tubular boom section comprising a tube having an inner end and an outer end and a holder mounted to said tube at said outer end, a double-acting hydraulic cylinder being attachable to said holder by said coupling, said coupling comprising:

a male member and a female member, one of said male member and said female member being attachable to an outer end of said double-acting hydraulic cylinder and the other of said male member and said female member being attachable to said holder, and one of said male member and said female member comprising a substantially part-spherical surface and the other of said male member and said female member comprising an opposite surface in contact with said substantially part-spherical surface, and means comprising a plurality of screws coupling together said substantially part-spherical surface and said opposite surface for preventing relataive pivotal movement between said substantially part-spherical surface and said opposite surface when said plurality of screws are tightened, and for permitting relative pivotal movement between said substantially part-spherical surface and said opposite surface when said plurality of screws are loosened.

* * * * *